US005492140A

United States Patent [19]

Lin et al.

[11] Patent Number: 5,492,140

[45] Date of Patent: Feb. 20, 1996

[54] MULTIPLE-FOLD AUTOMATIC UMBRELLA WITH SIMPLIFIED GRIP

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 508,792

[22] Filed: Jul. 28, 1995

[51] Int. Cl.[6] ..... A45B 25/14

[52] U.S. Cl. ..... 135/24; 135/22; 135/20.3

[58] Field of Search ..... 135/22, 23, 24, 135/25.1, 28, 29, 20.3, 25.4

[56] References Cited

U.S. PATENT DOCUMENTS

| | | | |
|---|---|---|---|
| 3,677,274 | 7/1972 | Yasuda et al. | 135/24 |
| 4,941,494 | 7/1990 | Wu | 135/24 X |
| 4,989,625 | 2/1991 | Wu | 135/24 X |
| 5,178,174 | 1/1993 | Wu | 135/24 X |
| 5,232,004 | 8/1993 | Wu | 135/24 |
| 5,441,065 | 8/1995 | Lin et al. | 135/24 |

*Primary Examiner*—Lanna Mai

[57] ABSTRACT

A multiple-fold automatic umbrella includes: a control device for controlling the opening and closing of the umbrella by excavating the grip of the umbrella for reducing the weight and volume of the umbrella for making a compact foldable umbrella, an opening controller of the control device formed as a sliding plate transversely slidably mounted in an upper portion of the grip for opening the umbrella from a closed state of the umbrella; and a spring plate held in the grip for respectively urging the opening controller formed on the upper portion of the grip and a closing controller of the control device having a sliding latch slidably mounted in a lower portion of the grip for closing an opened umbrella, thereby simplifying the control device and the grip of the automatic umbrella.

2 Claims, 5 Drawing Sheets

MULTIPLE-FOLD AUTOMATIC UMBRELLA WITH SIMPLIFIED GRIP

BACKGROUND OF THE INVENTION

This application is an improvement of U.S. patent application entitled "Multiple-fold Automatic Umbrella for Safe Operation" with Ser. No. 08/370,411 filed: Jan. 9, 1995 by the same inventors of this application. However, the earlier application of U.S. Ser. No. 370,411 has the following drawbacks:

1. In order to pivotally mount the elongated opening lever 52 of the control means 5 on the upper portion of the grip 12 secured to the lower portion of the central shaft means 1, the length of the grip 12 may not be shortened, thereby influencing the total umbrella length when folded and being not suitable for folding purpose.

2. Two springs 524, 543 should be provided for respectively urging the upper opening lever 52 and the lower sliding latch 54 to increase assembly complexity and production cost.

3. For accommodating the elements of the control means 5 in the grip 12, a "solid block" should be inserted in the grip 12 in order for slidably mounting the latch 54, for inserting the spring 543, and for pivotally mounting the lever 52 on the "solid block" embedded in the hollow grip portion to increase the volume and weight of the umbrella, thereby influencing the shortening and minimizing of a folded umbrella.

The present inventors have found the drawbacks of the U.S. patent application of U.S. Ser. No. 08/370,411 and invented the present multiple-fold automatic umbrella with simplified grip portion.

SUMMARY OF THE INVENTION

The object of the present invention is to provide a multiple-fold automatic umbrella including: a control device for controlling the opening and closing of the umbrella by excavating the grip of the umbrella for reducing the weight and volume of the umbrella for making a compact foldable umbrella, an opening controller of the control device formed as a sliding plate transversely slidably mounted in an upper portion of the grip for opening the umbrella from a closed state of the umbrella; and a spring plate held in the grip for respectively urging the opening controller formed on the upper portion of the grip and a closing controller of the control device having a sliding latch slidably mounted in a lower portion of the grip for closing an opened umbrella, thereby simplifying the control device and the grip of the automatic umbrella.

DETAILED DESCRIPTION

Figure 1:
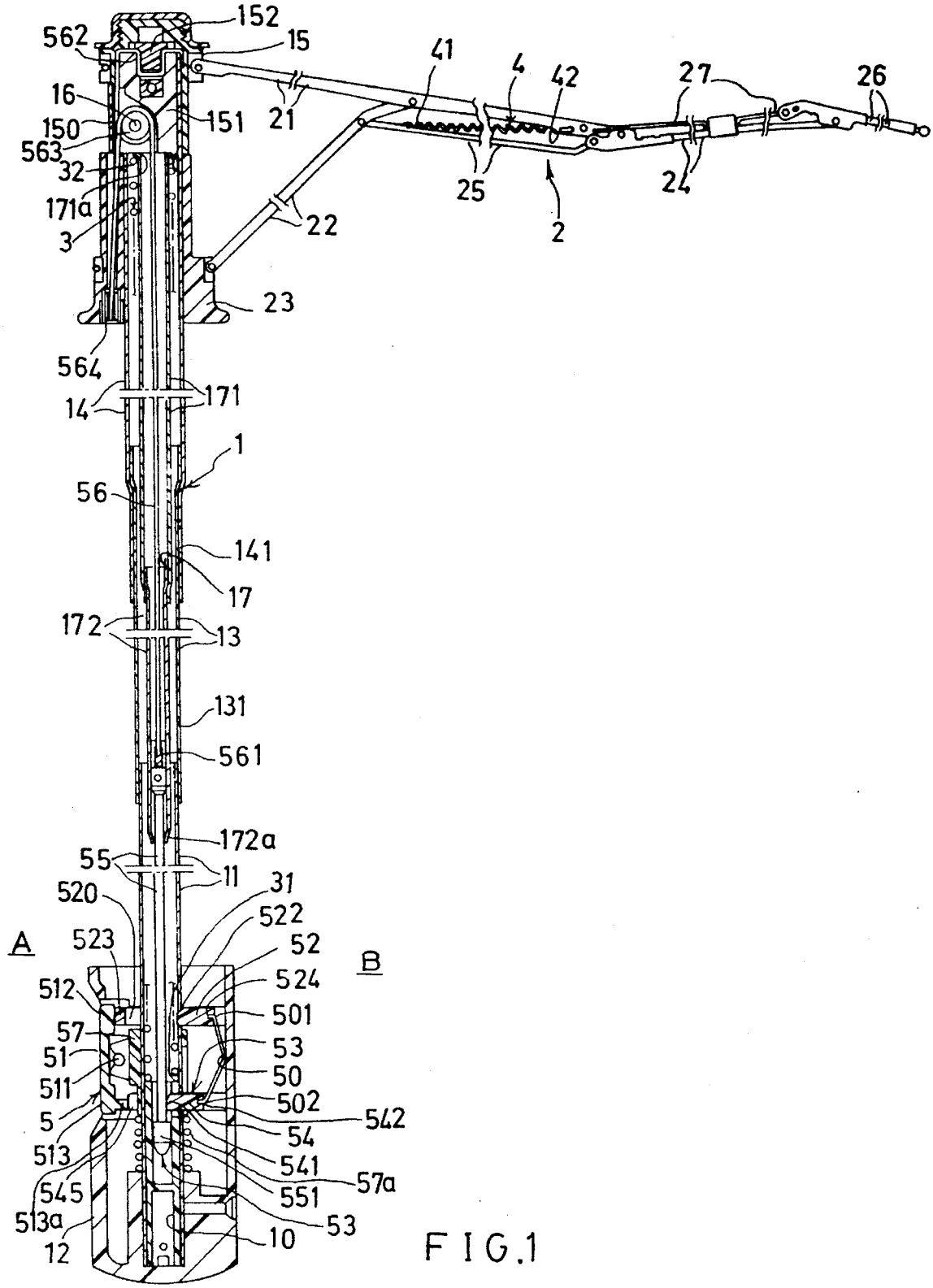
FIG. 1 shows an opened umbrella in accordance with the present invention.

As shown in the drawing figures, the present invention comprises: a central shaft means 1, a rib assembly 2, an opening umbrella 3, a plurality of closing springs 4, and a control means 5.

The central shaft means 1 includes: an inner (or lower) tube 11, a grip 12 having a lower tube portion of the inner tube 11 fixed in a central portion of the grip 12, a lower sleeve 10 inserted in a central lower portion of the grip 12, a middle tube 13 slidably held on an outer and upper side of the inner tube 11, an outer (or upper) tube 14 slidably held on an outer and upper side of the middle tube 13, an upper notch 15 secured on a top portion of the outer tube 14, and a central sleeve set 17 including an inner sleeve section 172, and an outer sleeve section 171 telescopically coupled with the inner sleeve section 172 having an uppermost sleeve portion **171*a* of the outer sleeve section 171 contiguous to an upper portion of the outer tube 14**.

The rib assembly 2 includes: a top rib 21 having an inner rib portion of the top rib 21 pivotally secured to the upper notch 15 of the central shaft means 1, an inner stretcher rib 22 having an inner rib portion of the inner stretcher rib 22 pivotally secured to a lower runner 23 which is slidably held on the outer tube 14 and having an outermost rib end of the inner stretcher rib 22 pivotally connected with a middle portion of the top rib 21, an intermediate rib 24 having an inner rib end of the intermediate rib 24 pivotally connected with an outermost rib end of the top rib 21 and having an innermost rib end of the intermediate rib 24 pivotally connected with an intermediate connecting rod 25 of which an inner rod end of the intermediate connecting rod 25 is pivotally secured to an outer rib portion of the inner stretcher rib 22, and a rear rib 26 having an inner rib portion of the rear rib 26 pivotally connected with an outer rib portion of the intermediate rib 24 and having an innermost rib end of the rear rib 26 pivotally connected with a spring rod 27 of which an inner rod end of the spring rod 27 is pivotally connected with an outer rib portion of the top rib 21.

The opening spring 3 for opening an umbrella of this invention has a lower spring end 31 retained on an upper edge portion of the lower sleeve 10, and an upper spring end 32 retained on a bottom portion of an inner block 151 inserted in an upper portion of the outer tube 14, the opening spring 3 slidably disposed about the central sleeve set 17.

Each closing spring 4 of the plurality of the closing springs 4 has an inner spring end 41 of the closing spring 4 secured to an inner connection portion of the intermediate connecting rod 25, and an outer spring end 42 of the closing spring 4 secured to an outer rib portion of the top rib 21. The closing spring 4 is provided for operatively closing an umbrella from its opened state by an elastic energy stored when opening the umbrella. Other locations for installing the closing spring 4 on the rib means 2 may be considered.

The control means 5 includes: a push button 51 pivotally mounted on a button holder 121 in the grip 12 by a pivot 511 and normally held in a button hole **120*a* in the grip 12, an upper latch 52 slidably held in an upper groove 122 recessed in an upper portion of the grip 12 and operatively depressed by an upper button portion 512 of the push button 51 for opening the umbrella, a closing controller 53 operatively depressible by a depression block 513***a* formed on a lower button portion 513 of the push button 51 for disengaging a locking head 551, which is secured with a drag rod 55 coupled to a drag rope 56 which is linked through the lower runner 23 to an upper portion of the outer tube 14, from a lower latch 54 slidably held in a lower portion of the grip 12, thereby allowing each said closing spring 4 to be restored to release its pre-stored elastic energy for closing the umbrella from an opened state, and an anti-false operation safety means 57 normally shielding the closing controller 53 to prevent a false operation to depress the closing controller 53 before fully opening the umbrella.

The upper latch 52 is generally formed as a thin plate to be slidably held in an upper groove 122 of the grip 12 and includes a depression portion 523 formed on a first end portion of the upper latch 52 adjacent to a first side A of the central shaft means 1, an upper projection 522 formed on a second end portion of the upper latch 52 and protruding from a second side B of the shaft means 1 towards a central latch hole 520 and the first side A to be engageable with a lower hole 141 formed in the outer tube 14, a lower hole 131 formed in the middle tube 13 and a lower hole 111 in the inner tube 11 for locking an umbrella under a closed state, the central latch hole 520 formed in a central portion of the upper latch 52 for downwardly passing a lower tube portion of each outer tube 14 and middle tube 13 when folding the central shaft means 1 for closing the umbrella, and an upper spring socket 524 formed on the second end portion of the upper latch 52 for retaining an upper spring end 501 of a restoring spring 50 held in the grip 12 adjacent to the second side B of the shaft means 1 to urge the upper latch 52 outwardly towards the first side A of the shaft means 1 to be operatively depressed by the upper button portion 512 of the push button 51 for disengaging the upper projection 522 from the lower holes 141, 131, 111 of the outer, middle and inner tubes 14, 13, 11 for opening the umbrella as resiliently tensioned by the opening spring 3.

The closing controller 53 includes: a lower latch 54 slidably held in a lower groove 123 recessed in a lower portion of the grip 12 and having a lower projection 541 protruding from a spring retaining portion 542 of the lower latch 54 towards the first side A of the shaft means 1 to be engageable with the locking head 551 secured with the drag rod 55, a pair of arm members 545 bifurcated from the lower projection 541 and protruding towards the push button 51 at a first side A of the central shaft means 1 to be operatively depressed by the depression block 513a formed on the lower button portion 513 of the push button 51 for closing an umbrella from an opened state, with the spring retaining portion 542 secured with a lower spring end 502 of the restoring spring 50 adjacent to the second side B of the shaft means 1 for normally urging the lower latch 54 outwardly to be operatively depressed by the depression block 513*a* formed on the lower button portion 513 of the push button 51.

The drag rod 55 has a lower rod end secured to the locking head 551 and an upper rod end coupled to a drag rope 56, with the drag rod 55 slidably held in the inner sleeve section 172 of the central sleeve set 17.

The drag rope 56 includes: the lower rope end 561 secured to the drag rod 55, an upper rope end 562 fixed to a top portion 152 of the outer tube 14 and in the upper notch 15, an upper guiding roller 563 rotatably mounted by a upper pivot 16 in the inner block 151 secured in a top portion of the outer tube 14 and in the upper notch 15 for slidably guiding the drag rope 56 from inside the outer tube 14 and the central sleeve set 17 telescopically held within the inner tube 11, the middle tube 13, and the outer tube 14 through the upper guiding roller 563 towards a lower guiding roller 564 through a rope passage 150 formed in the upper notch 15, the rope 56 with an upper rope section passing through the lower guiding roller 564 to have the upper rope end 562 fixed to the top portion 152 of the outer tube 14 and inside the inner block 151.

Figure 4:
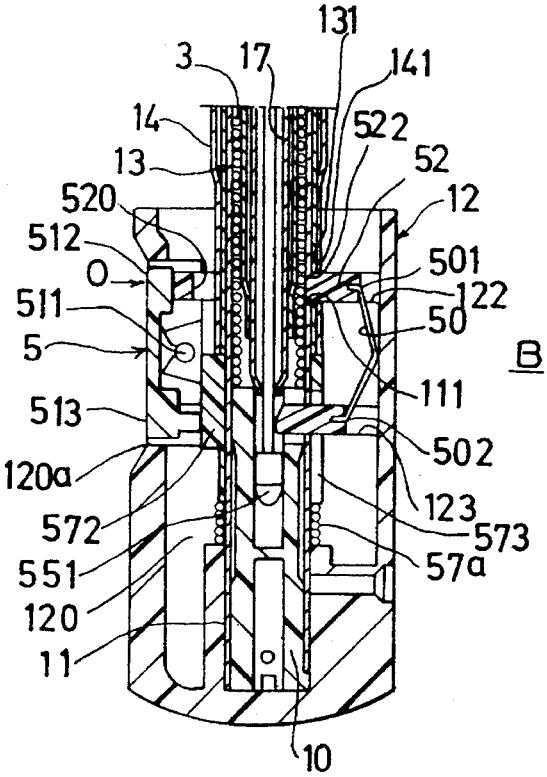
FIG. 4 is a sectional drawing of the grip of the present invention as shown in FIG. 3.
Figure 5:
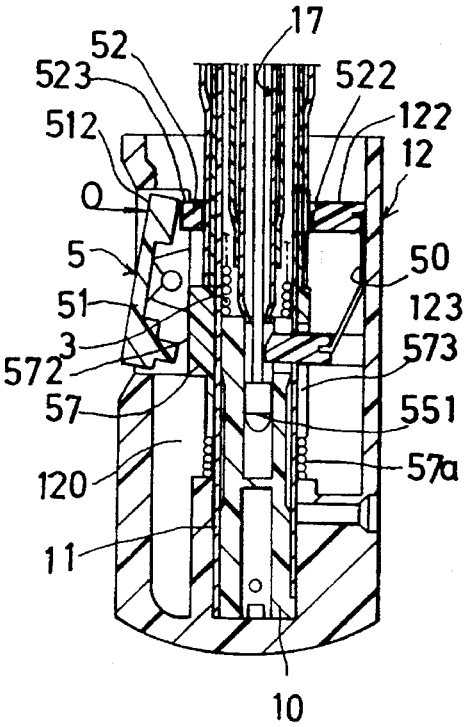
FIG. 5 is an illustration of the present invention when depressing the upper button portion of the push button of the control means for opening the umbrella.
Figure 6:
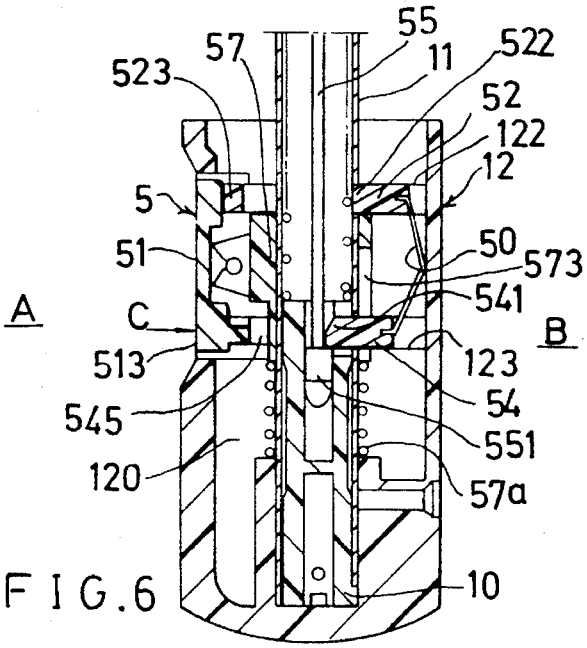
FIG. 6 shows the grip of the present invention as shown in FIG. 1.
Figure 7:
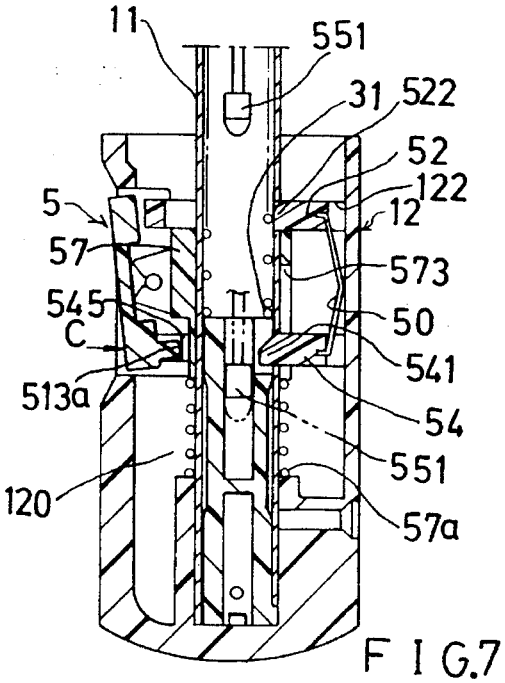
FIG. 7 shows a depression of the lower button portion of the push button for closing the umbrella of the present invention.
Figure 8:
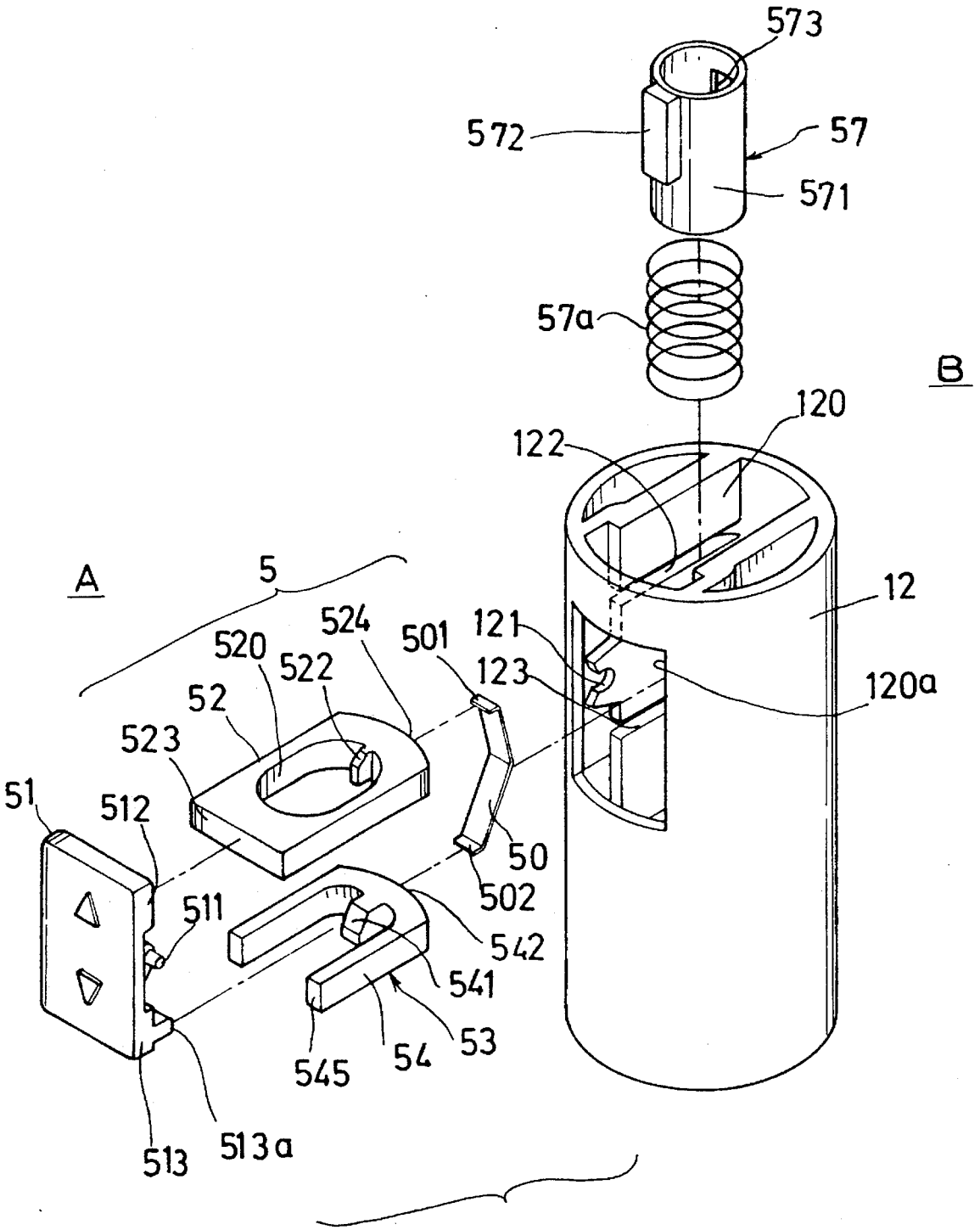
FIG. 8 is an exploded view showing the elements of the control means of the present invention.

The anti-false operation safety means 57 includes: a cylinder 571 slidably disposed around a lower portion of the inner tube 11 and resiliently rested on a cylinder spring 57*a* retained in a lower portion of the grip 12, a retarding extension 572 protruding outwardly from the cylinder 571, the retarding extension 572 operatively positioned to be juxtapositional to the pair of arm members 545 of the lower latch 54 to retard an inward depression on the arm members 545 by the lower button portion 513 of the push button 51 for preventing a false operation of the closing controller 53 when the central shaft means 1 is folded to lower the outer and middle tubes 14, 13 to allow a bottom end of each middle tube 13 and outer tube 14 to downwardly press the cylinder 571 and cylinder spring 57*a* downwardly for restoring the spring energy of the cylinder spring 57*a* as shown in FIG. 4 whereby the outer and middle tubes 14, 13 are locked by engaging the upper projection 522 with the lower holes 141, 131, 111, and a slot 573 longitudinally formed in the cylinder 571 adjacent to the second side B of the shaft means 1 for slidably engaging the lower projection 541 of the lower latch 54 for slidably moving of the safety means 57 on the inner tube 11 as shown in FIGS. 4, 6.

Figure 3:
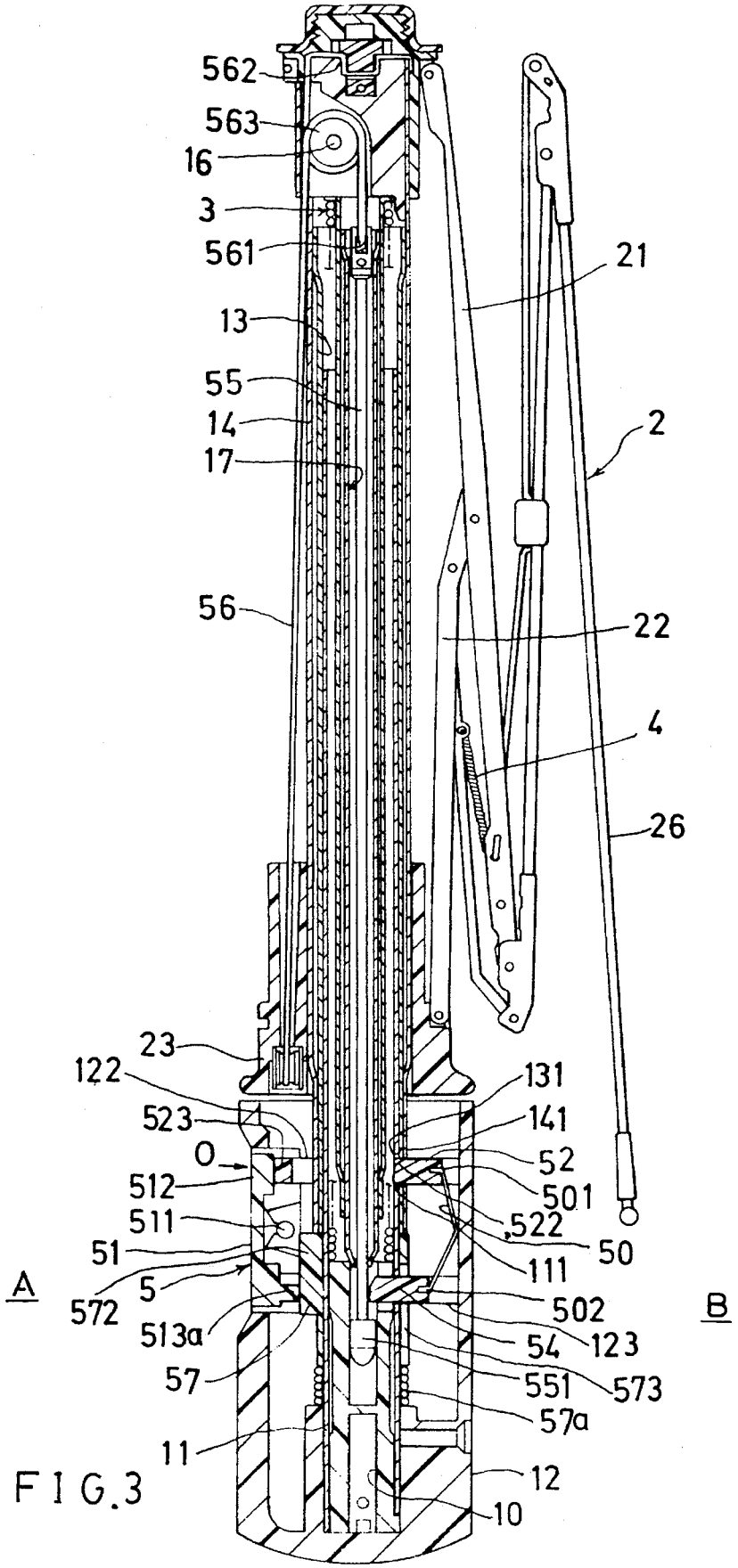
FIG. 3 shows a folded umbrella when re-set from FIG. 2.

When opening the umbrella of the present invention as shown from FIG. 3 to FIG. 1, the upper button portion 512 of the push button 51 is depressed (O) to force the depression portion 523 of the upper latch 52 to retract the upper projection 522 to disengage from the holes 141, 131, 111 formed in the tubes 14, 13, 11 of the shaft means 1 to release the opening spring 3, which is previously compressed when re-setting the umbrella for storing the elastic energy of the opening spring as shown in FIG. 3, to extend the tubes 14, 13, 11 and open the ribs of the rib assembly 2 for opening the umbrella. The closing springs 4 are also tensioned to store their restoring elastic energy by the opening operation of the umbrella as effected by the opening spring 3.

Figure 2:
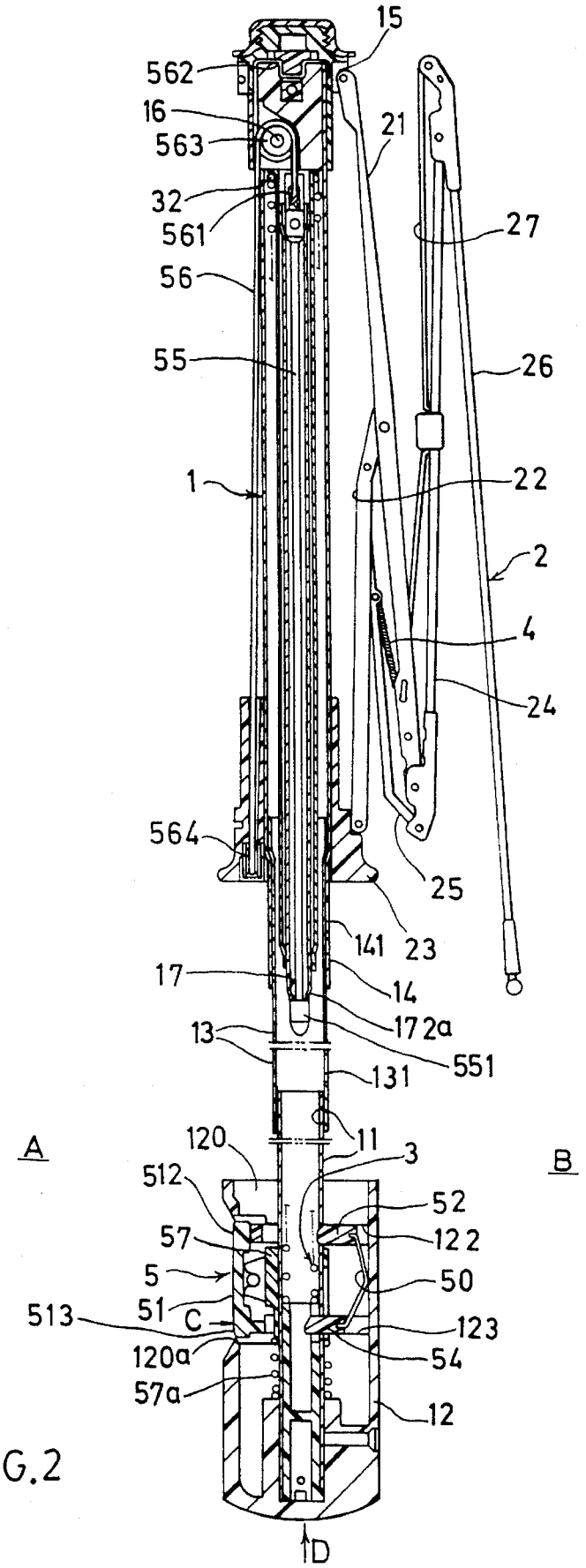
FIG. 2 shows a closed umbrella of the present invention when folded from FIG. 1.

When closing the umbrella from FIG. 1 to FIG. 2, the lower button portion 513 of the push button 51 is depressed (C) to force the lower latch 54 of the closing controller 53 towards the second side B of shaft means 1 to disengage the locking head 551 from the lower projection 541 of the lower latch 54 to allow a downward movement of the runner 23 required for closing the umbrella, and the closing springs 4 will restore to lower the runner 23 to retract the ribs of the rib assembly 2 and fold the tubes 14, 13, 11 as shown in FIG. 2. The locking head 551 will then be raised to be stopped at a lower sleeve portion 172*a* of the sleeve set 17. The retarding extension 572 and the cylinder 571 will be moved upwardly as upwardly urged by the cylinder spring 57*a* when opening the umbrella and raising the tubes 14, 13, thereby causing no obstruction for the inward depression of the lower button portion 513 of the button 51 for a normal closing operation of the umbrella (from FIG. 1 to FIG. 2).

For re-setting the folded or closed umbrella to store an elastic energy of the opening spring 3, the grip 12 may be depressed (D) towards a tip portion of the umbrella (FIG. 2 to FIG. 3) for compressing the spring 3 ready for next opening use.

The present invention may be used for an automatic umbrella having triple folds or multiple folds. The upper and lower latches 52, 54 are all transversely slidably held in the hollow grip 12 for simplifying the structure of the control means 5 and the grip 12 and for minimizing the volume and weight of the grip and the umbrella, helpful for making compact and cheaper automatic umbrella.

We claim:

1. An automatic umbrella comprising:

a central shaft means including: an inner tube, a grip secured with the inner tube, a middle tube slidably held on an outer and upper side of the inner tube, an outer tube slidably held on an outer and upper side of the middle tube, an upper notch secured on a top portion of the outer tube, and a central sleeve set telescopically held within said inner, middle and outer tubes;

a rib assembly including a plurality of rib pivotally connected with one another and pivotally secured between the upper notch and a lower runner slidably held on said central shaft means;

an opening spring for opening an umbrella retained in said central shaft means and slidably disposed about the central sleeve set;

a plurality of closing springs respectively secured on said rib assembly for operatively closing an umbrella from an opened state by an elastic energy stored when opening the umbrella; and a control means including: a push button pivotally mounted in the grip by a pivot and normally held in a button hole in the grip, an upper latch slidably held in an upper portion of the grip and operatively depressed by an upper button portion of the push button for opening the umbrella, a closing controller operatively depressible by a lower button portion of the push button for disengaging a locking head, which is secured with a drag rod coupled to a drag rope which is linked through the lower runner to an upper portion of the outer tube, from a lower latch slidably held in a lower portion of the grip, thereby allowing each said closing spring to be restored to release its pre-stored elastic energy for closing the umbrella from an opened state, and an anti-false operation safety means normally shielding the closing controller to prevent a false operation to depress the closing controller before fully opening the umbrella;

the improvement which comprises:

said upper latch including a depression portion formed on a first end portion of the upper latch adjacent to a first side of the central shaft means, an upper projection formed on a second end portion of the upper latch and protruding from a second side of the shaft means towards a central latch hole to be engageable with a lower hole formed in each said tube of the outer tube, the middle tube and the inner tube for locking an umbrella under a closed state, the central latch hole formed in a central portion of the upper latch for downwardly passing a lower tube portion of each said outer tube and middle tube when folding the central shaft means for closing the umbrella, and an upper spring socket formed in the second end portion of the upper latch for retaining an upper spring end of a restoring spring held in the grip adjacent to the second side of the shaft means to urge the upper latch outwardly towards the first side of the shaft means to be operatively depressed by the upper button portion of the push button for disengaging the upper projection from each said lower hole of the outer, middle and inner tubes for opening the umbrella as resiliently tensioned by the opening spring; and said closing controller including: a lower latch slidably held in a lower portion of the grip and having a lower projection protruding from a spring retaining portion of the lower latch towards the first side of the shaft means to be engageable with the locking head secured with the drag rod, a pair of arm members bifurcated from the lower projection and protruding towards the push button at a first side of the central shaft means to be operatively depressed by the lower button portion of the push button for closing an umbrella from an opened state, with the spring retaining portion secured with a lower spring end of the restoring spring adjacent to the second side of said shaft means for normally urging the lower latch outwardly to be operatively depressed by the lower button portion of the push button, and said anti-false operation safety means having a slot slidably engageable with said lower projection of said lower latch.

2. An automatic umbrella according to claim 1, wherein said anti-false operation safety means includes: a cylinder slidably disposed around a lower portion of the inner tube and resiliently rested on a cylinder spring retained in a lower portion of the grip, a retarding extension protruding outwardly from the cylinder, the retarding extension operatively positioned to be juxtapositional to the pair of arm members of the lower latch to retard an inward depression on the arm members by the lower button portion of the push button for preventing a false operation of the closing controller when the central shaft means is folded to lower the outer and middle tubes to allow a bottom end of each said middle tube and outer tube to downwardly press the cylinder and cylinder spring downwardly for restoring the spring energy of the cylinder spring whereby the outer and middle tubes are locked by engaging the upper projection with the lower holes formed in said tubes, and said slot longitudinally formed in the cylinder adjacent to the second side of the shaft means for slidably passing the lower projection of the lower latch for a sliding movement of said cylinder on said inner tube.

* * * * *